US012000235B2

(12) United States Patent
Rossing

(10) Patent No.: US 12,000,235 B2
(45) Date of Patent: Jun. 4, 2024

(54) SYSTEM AND METHOD FOR CEMENTING A TUBING

(71) Applicant: National Oilwell DHT, L.P., Houston, TX (US)

(72) Inventor: Michael Rossing, Houston, TX (US)

(73) Assignee: National Oilwell DHT, L.P.

( * ) Notice: Subject to any disclaimer, the term of this patent is extended or adjusted under 35 U.S.C. 154(b) by 7 days.

(21) Appl. No.: 17/784,565

(22) PCT Filed: Jan. 7, 2021

(86) PCT No.: PCT/US2021/012482
§ 371 (c)(1),
(2) Date: Jun. 10, 2022

(87) PCT Pub. No.: WO2021/142107
PCT Pub. Date: Jul. 15, 2021

(65) Prior Publication Data

US 2023/0003099 A1 Jan. 5, 2023

Related U.S. Application Data

(60) Provisional application No. 62/958,579, filed on Jan. 8, 2020.

(51) Int. Cl.
*E21B 28/00* (2006.01)
*E21B 33/13* (2006.01)

(52) U.S. Cl.
CPC ..... *E21B 33/13* (2013.01); *E21B 28/00* (2013.01)

(58) Field of Classification Search
CPC ..... E21B 33/13; E21B 28/00
See application file for complete search history.

(56) References Cited

U.S. PATENT DOCUMENTS

| | | | |
|---|---|---|---|
| 3,557,875 | A | 1/1971 | Solum et al. |
| 7,337,519 | B2 | 3/2008 | Parker |
| 8,726,993 | B2 | 5/2014 | Cooke, Jr. |
| 9,506,318 | B1 | 11/2016 | Brunet |

(Continued)

FOREIGN PATENT DOCUMENTS

| | | | |
|---|---|---|---|
| EP | 1682746 | B1 | 5/2010 |
| WO | 2017015144 | A1 | 1/2017 |

OTHER PUBLICATIONS

International Search Report and Written Opinion dated Mar. 26, 2021 in counterpart International Application serial No. PCT/US2021/012484, 13 pages.

*Primary Examiner* — Taras P Bemko
(74) *Attorney, Agent, or Firm* — Jonathan Pierce; Pierre Campanac; Porter Hedges LLP

(57) ABSTRACT

At least one of pressure pulses, lateral oscillations, and axial oscillations can be generated by a distal downhole tool and a proximal downhole tool while cement is pumped into a well for cementing the well. Also, the generation of at least one of pressure pulses, lateral oscillations, and axial oscillations by the proximal downhole tool can continue even when the cement is no longer pumped around a tubing and is curing. In order to do so, a backflow path from a point downstream of the second vibration tool toward a wellhead is provided. Then a fluid, usually other than cement, is pumped from the wellhead, through the proximal downhole tool, and back into an annulus toward the wellhead. As such, a production tubing may remain centralized while the cement is curing.

17 Claims, 6 Drawing Sheets

(56) References Cited

U.S. PATENT DOCUMENTS

| | | | |
|---|---|---|---|
| 9,637,991 | B2 | 5/2017 | Eddison et al. |
| 2005/0284624 | A1 | 12/2005 | Libby et al. |
| 2007/0187112 | A1 | 8/2007 | Eddison et al. |
| 2017/0016305 | A1 | 1/2017 | Prieur et al. |

SYSTEM AND METHOD FOR CEMENTING A TUBING

CROSS-REFERENCE TO RELATED APPLICATIONS

This application is a national stage entry of International Application serial number PCT/US2021/012482, filed on Jan. 7, 2021, which claims the benefit of priority to U.S. provisional application Ser. No. 62/958,579, filed on Jan. 8, 2020, which are incorporated herein by reference for all and any purposes.

BACKGROUND

This disclosure relates generally to systems and methods for cementing a tubing in a well. This disclosure relates more particularly to systems and methods that utilize at least one of pressure pulses, lateral oscillations, and axial oscillations during the pumping and/or the curing of the cement.

PCT application publication no. WO 2017/015144 discloses a method of cementing an oil or gas well for abandonment. An agitator assembly comprising an agitator, a packer, and a burst sub, with a running tool fitted to the top, is run down a production tubing on wireline. Cement flows through the agitator assembly and causes the production tubing to vibrate. The vibration of the production tubing assists the formation of a good quality cement plug extending all around the production tubing over a substantial length of the well. More than one agitator may be deployed at intervals along the production tubing.

When the flow of cement through the agitator assembly stops, the production tubing may cease to vibrate. When the production tubing ceases to vibrate, and the cement has not set (i.e., the cement is not cured), the production tubing may move against the casing, possibly compromising the quality of the cement plug. The production tubing is particularly prone to move against the casing under the effect of gravity in horizontal or highly deviated wells.

Thus, there is a continuing need in the art for systems and methods for cementing a tubing. Preferably, the systems and methods are designed to generate at least one of pressure pulses, lateral oscillations, and axial oscillations during the pumping and/or the curing of the cement.

SUMMARY

The disclosure describes a method of cementing a tubing.

The method may comprise the step of attaching in the tubing a distal downhole tool that includes a first flow-through passage extending through the distal downhole tool and a first vibration tool. For example, attaching the distal downhole tool in the tubing may involve extending an anchor including one or more slip-cone assemblies and causing the slips to grip against the tubing, or latching the distal downhole tool to a nipple profile forming a part of the tubing.

The method may comprise the step of attaching in the tubing a proximal downhole tool that includes a second flow-through passage extending through the proximal downhole tool and a second vibration tool. For example, attaching the proximal downhole tool in the tubing may involve extending an anchor including one or more slip-cone assemblies and causing the slips to grip against the tubing, or latching the proximal downhole tool to a nipple profile forming a part of the tubing.

The method may comprise the step of generating at least one of pressure pulses, lateral oscillations, and axial oscillations the first vibration tool as well as with the second vibration tool by flowing cement in the second flow-through passage.

The method may comprise the step of preventing flow of cement between the distal downhole tool and the tubing using a packer included in the distal downhole tool.

The method may comprise the step of flowing cement around a portion of the tubing.

The method may comprise the step of providing a backflow path from a point downstream of the second vibration tool toward a wellhead. The backflow path from the point downstream of the second vibration tool toward the wellhead may be provided with an annular space between the tubing and a casing surrounding the tubing, or an annular space between the tubing and a circulation means located inside the tubing. The backflow path may pass through a hole in the tubing, a packer located near or at the wellhead, or an unloader valve connected to the second flow-through passage.

The method may comprise the step of generating at least one of pressure pulses, lateral oscillations, and axial oscillations with the second vibration tool by flowing fluid through the second flow-through passage while the cement is curing. The fluid may include Lost Circulation Material (LCM).

The method may comprise the step of applying a squeeze pressure to the cement while the cement is curing.

The method may comprise the step of flowing the fluid in the backflow path.

The disclosure also describes a system for cementing a tubing.

The system may comprise a distal downhole tool. The distal downhole tool may include means for attaching the distal downhole tool in the tubing, a first flow-through passage extending through the distal downhole tool, and a first vibration tool. The means for attaching the distal downhole tool in the tubing may comprise an extendable anchor including one or more slip-cone assemblies, or a mechanism for latching the distal downhole tool to a nipple profile forming a part of the tubing. The first vibration tool may be capable of generating at least one of pressure pulses, lateral oscillations, and axial oscillations by flowing cement in the first flow-through passage. Preferably, the distal downhole tool may comprise a packer capable of preventing flow of the cement between the distal downhole tool and the tubing. For example, wherein the first vibration tool may include at least one of a pressure-pulser and an agitator.

The system may comprise a proximal downhole tool. The proximal downhole tool may include means for attaching the proximal downhole tool in the tubing, a second flow-through passage extending through the proximal downhole tool, and a second vibration tool. The means for attaching the proximal downhole tool in the tubing may comprise an extendable anchor including one or more slip-cone assemblies, or a mechanism for latching the distal proximal downhole tool to a nipple profile forming a part of the tubing. The second vibration tool may be capable of generating at least one of pressure pulses, lateral oscillations, and axial oscillations by flowing the cement in the second flow-through passage and by flowing fluid through the second flow-through passage while the cement is curing. For example, wherein the second vibration tool may include at least one of a pressure-pulser and an agitator.

The system may comprise means for providing a backflow path from a point downstream of the second vibration tool toward a wellhead. The means for providing the backflow path from the point downstream of the second vibration tool toward the wellhead may comprise an annular space between the tubing and a casing surrounding the tubing, or an annular space between the tubing and a circulation means located inside the tubing. The means for providing the backflow path from the point downstream of the second vibration tool toward the wellhead may also comprise a hole in the tubing, a packer located near or at the wellhead, or an unloader valve connected to the second flow-through passage.

BRIEF DESCRIPTION OF THE DRAWINGS

For a more detailed description of the embodiments of the disclosure, reference will now be made to the accompanying drawings, wherein.

DETAILED DESCRIPTION

The disclosure describes systems and methods that permit the generation of at least one of pressure pulses, lateral oscillations, and axial oscillations to continue even when cement is no longer pumped around a tubing and is curing. These systems and methods involve pumping a fluid, usually other than cement, from the wellhead, through a vibration device that can generate at least one of pressure pulses, lateral oscillations, and axial oscillations, and back into an annulus toward the wellhead. The annulus may be located around a circulation means provided inside the tubing being cemented, in which case, the annulus may be confined inside the tubing. Alternatively, the annulus can be located around the tubing being cemented, in which case, the annulus is confined inside a casing surrounding the tubing. Flow in the annulus can optionally be controlled, for example, via a packer located near or at the wellhead, an unloader valve, or a punching sub capable of making a hole in the tubing.

Figure 1A:
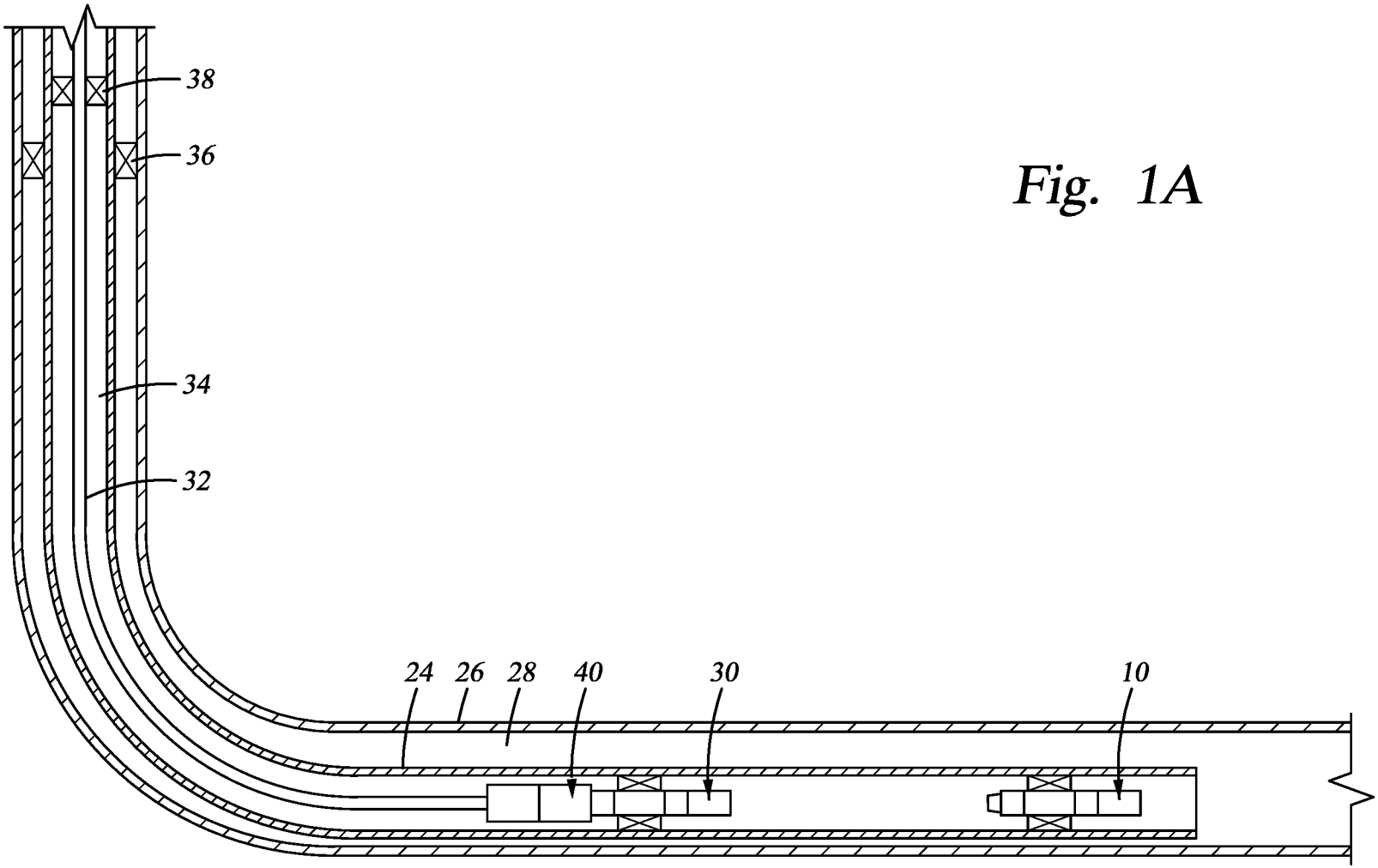
FIG. 1A illustrates an example embodiment of a system for cementing a production tubing that utilizes at least one of pressure pulses, lateral oscillations, and axial oscillations during the pumping and/or the curing of the cement.
Figure 1B:
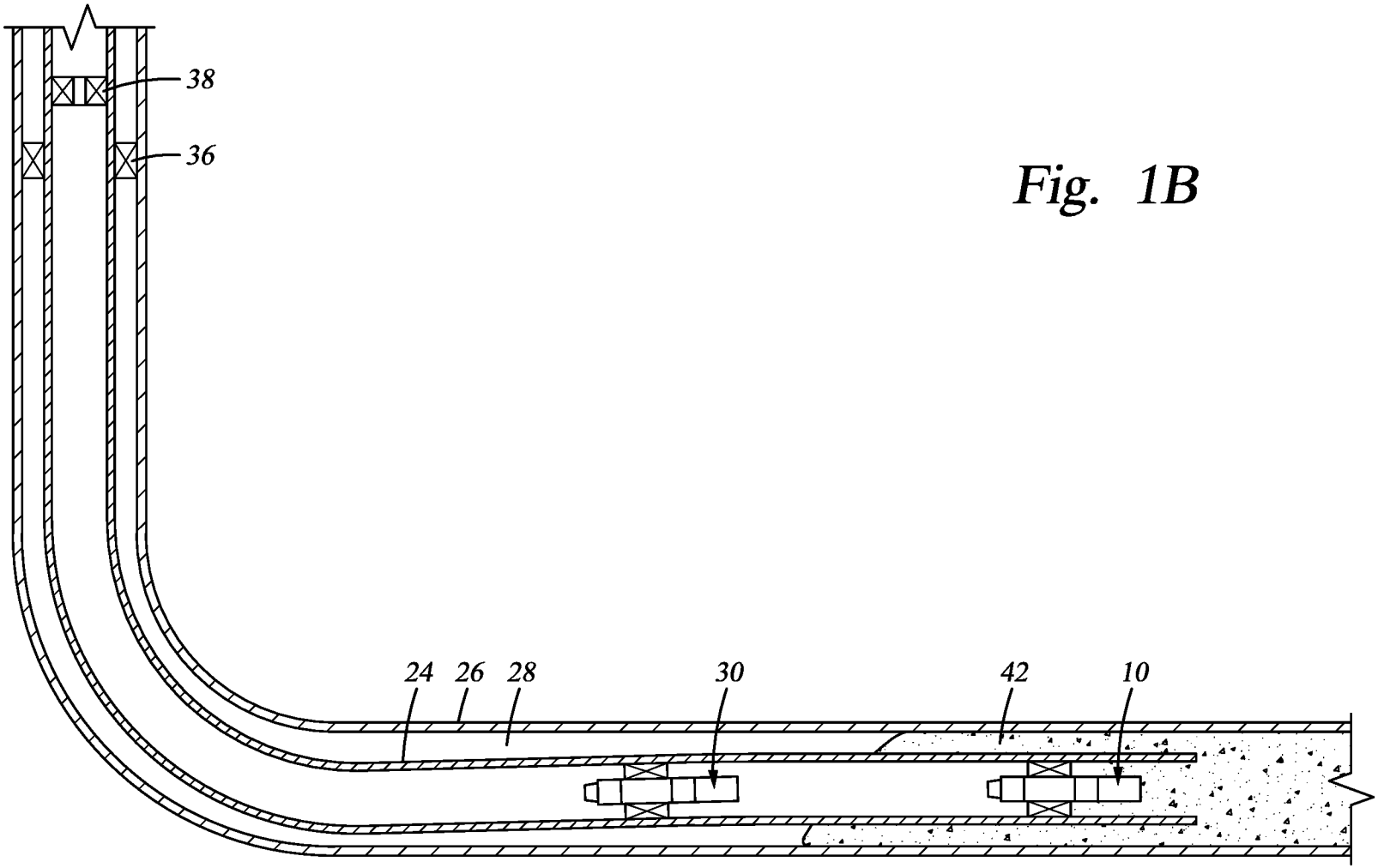
FIG. 1B illustrates the system shown in FIG. 1A after the pumping and/or the curing of the cement and retrieval of a portion of the system.

FIGS. 1A and 1B illustrate the operation of a system for cementing a tubing, such as a production tubing 24, which is located inside a casing 26. As shown in FIGS. 1A and 1B, the casing 26 and/or the production tubing 24 may be located in a horizontal or highly deviated well; however, the system may alternatively be used in wells having a different configuration.

The system may include a distal downhole tool 10 and a proximal downhole tool 30 that each includes a flow-through passage along the tool and a vibration device. The vibration device can generate at least one of pressure pulses, lateral oscillations, and axial oscillations during the pumping of the cement or other fluid in the flow-through passage.

As shown in FIG. 1A, the distal downhole tool 10 may be provided in the production tubing 24. For example, the distal downhole tool 10 may be connected to a setting tool and placed in the production tubing 24 using conveyance means, such as wireline, coiled tubing, or other known conveyance means.

The distal downhole tool 10 is attached to the production tubing 24. For example, the setting tool may be used to move an anchor included in the distal downhole tool 10 from a collapsed position to an extended position for gripping against the production tubing 24. Alternatively, the distal downhole tool 10 may latch to a device forming a part of the production tubing 24, such as a nipple profile or another completion component. Other known attachment means may be used for attaching the distal downhole tool 10 to the production tubing 24.

Preferably, a packer is included in the distal downhole tool 10. The packer, which may be used to prevent flow between the distal downhole tool 10 and the production tubing 24, is moved from a retracted position to an expanded position for sealing against the production tubing 24. For example, the setting tool may include an actuator configured to move the packer. Alternatively to a packer, the distal downhole tool 10 may be permanently shaped or selectively configurable such that the flow between the distal downhole tool 10 and the production tubing 24 is substantially more restricted than flow in the flow-through passage along the distal downhole tool 10.

Then, the setting tool may be disconnected from the distal downhole tool 10 and retrieved from the well so that the proximal downhole tool 30 can be provided in the production tubing 24.

In contrast with the distal downhole tool 10, which preferably includes a packer, the proximal downhole tool 30 preferably does not include a packer, or if a packer is provided, the packer is not expanded. As such, flow between the proximal downhole tool 30 and the production tubing 24 is preferably allowed. However, the proximal downhole tool 30 may include a packer that is expanded as well as an unloader valve positioned between the vibration device and the packer. The unloader valve is configured to be normally closed and selectively open a backflow path between the flow-through passage along the proximal downhole tool 30 and an annulus between the proximal downhole tool 30 and the production tubing 24 on a side of the packer that is the closest to the wellhead. When the backflow path is open, cement or other fluid can flow in the flow-through passage, generate at least one of pressure pulses, lateral oscillations, and axial oscillations, and then flow in the backflow path toward the wellhead. There are various ways to open the unloader valve.

Similarly to the distal downhole tool 10, the proximal downhole tool 30 is also attached to the production tubing 24. For example, a setting tool may be used to move an anchor included in the proximal downhole tool 30 from a collapsed position to an extended position for gripping against the production tubing 24. Alternatively, the proximal downhole tool 30 may latch to a device forming a part of the production tubing 24, such as a nipple profile or another completion component. Other known attachment means may be used for attaching the proximal downhole tool 30 to the production tubing 24.

In the embodiment illustrated in FIGS. 1A and 1B, the proximal downhole tool 30 is connected via a coupling tool 40 to circulation means, such as a coiled tubing 32, other umbilical, or other tubular, conduit, or pipe. The coupling tool 40 and the coiled tubing 32 provide a flow path from the wellhead through the coiled tubing 32 and a backflow path to the wellhead in an annulus 34 between the production tubing 24 and the coiled tubing 32.

The coupling tool 40 includes a latch sub and a flow-through passage extending from inside the coiled tubing 32 through the latch sub to an end of the coupling tool 40 opposite the coiled tubing 32. The proximal downhole tool 30 includes a connector, and the flow-through passage along the first proximal downhole tool 30 extends through the connector to an end of the proximal downhole tool 30 opposite the connector. In use, the connector of the proximal downhole tool 30 is engaged with the latch sub of the coupling tool 40. The connector of the proximal downhole tool 30 is configured to seal against the latch sub of the coupling tool 40 when the connector is engaged with the latch sub. Accordingly, a flow communication is established between the flow-through passage of the coupling tool 40 and the flow-through passage of the proximal downhole tool 30 when the connector is engaged with the latch sub. Thus, cement may be pumped into the coiled tubing 32 through the coupling tool 40 and the proximal downhole tool 30. Further, the cement may flow in the flow-through passage of the distal downhole tool 10.

During a cementing operation, annular seal 36, which is located near or at the wellhead, is at least partially opened, and cement 42 is pumped into the production tubing 24, for example, first into the coiled tubing 32, through the coupling tool 40 and the proximal downhole tool 30, and out of the proximal downhole tool 30. The cement 42 may continue to flow inside a portion of the production tubing 24 located between the proximal downhole tool 30, through the distal downhole tool 10, and out of the distal downhole tool 10. The cement 42 flows back into an annulus 28 between the production tubing 24 and the casing 26, toward the annular seal 36. The annular seal 36 may be partially choked to provide a squeeze pressure on the cement 42.

Preferably, a packer 38, which is located near or at the wellhead, may be used to prevent or at least to hinder the cement 42 from flowing back into the annulus 34 toward the wellhead after exiting the proximal downhole tool 30. However, in cases where the proximal downhole tool 30 includes a packer as well as an unloader valve, the packer of the proximal downhole tool 30 may be used instead of, or in addition to, the packer 38 for preventing or at least hindering the flow back on cement into the annulus 34 toward the wellhead. The unloader valve may remain closed during the pumping of the cement 42.

Each of the proximal downhole tool 30 and the distal downhole tool 10 can generate at least one of pressure pulses, lateral oscillations, and axial oscillations during the pumping of the cement 42. The pressure pulses, lateral oscillations, or axial oscillations are caused by the flow of cement through a vibration device included in the proximal downhole tool 30 and the distal downhole tool 10. The lateral oscillations and axial oscillations may be transmitted from the vibration tool to the production tubing 24 through the attachment of the proximal downhole tool 30 and the distal downhole tool 10 to the production tubing. As shown in FIG. 1B, these pressure pulses, lateral oscillations, or axial oscillations may cause a portion of the production tubing 24 to centralize inside the casing 26.

Further, the proximal downhole tool 30 can generate at least one of pressure pulses, lateral oscillations, and axial oscillations after the pumping of the cement 42 has ceased, and during the curing of the cement 42. To do so, the annular seal 36, if provided in the system, is closed. In cases where the packer 38, which is located near or at the wellhead, is provided in the system, the packer 38 is open. Alternatively, in cases where the proximal downhole tool 30 includes a packer as well as an unloader valve, the unloader valve is opened, such as by pulling (or pushing) on the coiled tubing 32. Then, fluid, usually other than cement, is pumped into the production tubing 24, for example, first into the coiled tubing 32, through the coupling tool 40 and the proximal downhole tool 30, and out of the proximal downhole tool 30. The fluid flows back into the annulus 34 toward the wellhead packer 38. The flow of the fluid through the vibration device included in the proximal downhole tool 30 causes these pressure pulses, lateral oscillations, or axial oscillations, which in turn may cause the production tubing 24 to remain centralized while the cement 42 is curing. The circulation of fluid may last for several hours, possibly a few days while the cement 42 is curing. Further, the circulation of fluid, the pressure pulses, lateral oscillations, and/or axial oscillations may apply a squeeze pressure to the cement 42 while the cement 42 is curing, thus improving the bond of the cement 42 to the casing 26 and/or to the production tubing 24. The fluid may include Lost Circulation Material ("LCM").

The system may comprise a release mechanism disposed along the proximal downhole tool 30, the coupling tool 40, or the coiled tubing 32. The release mechanism is configured to selectively disconnect a portion of coiled tubing 32 from a portion of the proximal downhole tool 30. As shown in FIG. 1B, the portion of coiled tubing 32 may be retrieved from the production tubing 24 while the portion of the proximal downhole tool 30 may remain in the production tubing 24 after the cement has cured.

While FIGS. 1A and 1B show only one distal downhole tool 10, a plurality of distal downhole tools may further be distributed along the production tubing 24, each offset from each other and from the proximal downhole tool 30. Each of the plurality of distal downhole tools includes a flow-through passage along the tool and a vibration device that can generate at least one of pressure pulses, lateral oscillations, and axial oscillations during the pumping of the cement or other fluid in the flow-through passage.

Figure 2:
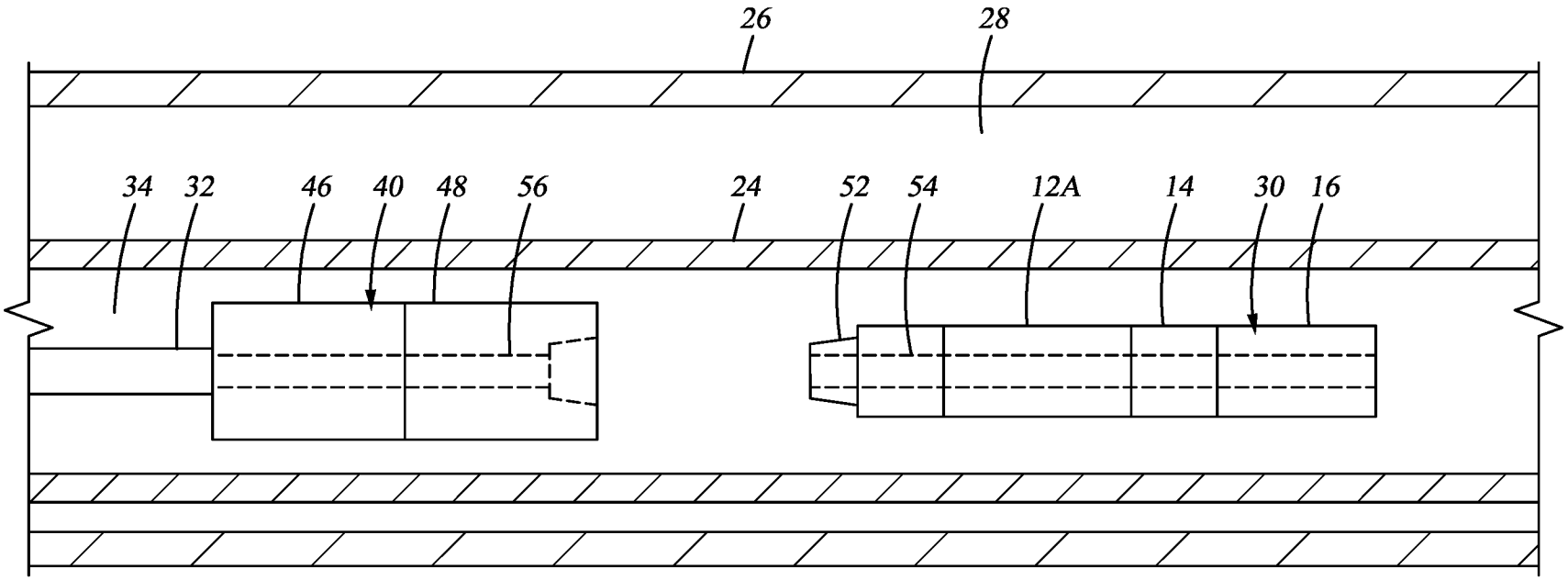
FIG. 2 illustrates an example embodiment of downhole tools shown coupled to a coiled tubing in FIG. 1A.

FIG. 2 illustrates an arrangement of the proximal downhole tool 30, the coupling tool 40, and a portion of the coiled tubing 32 shown in FIG. 1A.

The proximal downhole tool 30 comprises the connector 52, an anchor 12A, a vibration device 16, and a first flow-through passage 54 (shown in ghost lines) extending through the connector 52, the anchor 12A, and the vibration device 16. Optionally, a burst sub 14 can be provided to bypass the vibration device 16, in the event the vibration device 16 becomes plugged. The anchor 12A may include slip/cone assemblies having a collapsed position and an extended position wherein the slips are capable of gripping against the production tubing 24. Other known types of anchors may be used in the proximal downhole tool 30 instead of, or in addition to, the anchor 12A including the slip/cone assemblies. Preferably, the proximal downhole tool 30 does not include a packer. As such, the flow of the fluid around the proximal downhole tool 30 is allowed. The vibration device 16 is configured to generate at least one of pressure pulses, lateral oscillations, and axial oscillations by flowing cement or fluid through the first flow-through passage 54. For example, the vibration device 16 may be implemented as described in US application publication no. 2007/0187112, which is incorporated herein by reference in its entirety for all purposes. Other known types of vibration devices may be used in the proximal downhole tool 30 instead of, or in addition to, the vibration device 16 as described in US application publication no. 2007/0187112. For example, the vibration device 16 may be implemented using any known pressure-pulser, any known agitator, or any combination thereof.

In use, the proximal downhole tool 30 may be provided in the production tubing 24 suspended to a setting tool (not shown) and lowered via wireline, or other known conveyance means, inside the production tubing 24. When anchor 12A is located in the production tubing 24, the setting tool is activated. The activation of the setting tool extends the slips of the slip/cone assemblies so that the slips grip against the production tubing 24. The setting tool and the conveyance means may then be retrieved.

Then, the coupling tool 40, which is connected to the coiled tubing 32, may be lowered via the coiled tubing 32 inside the production tubing 24 until a latch sub 48 engages with a connector 52 of the proximal downhole tool 30. In FIG. 2, the coupling tool 40 is illustrated before engagement with the proximal downhole tool 30.

The coupling tool 40 comprises the latch sub 48, a release mechanism 46, and a second flow-through passage 56 (shown in ghost lines) extending from the coiled tubing 32 through the release mechanism 46 and the latch sub 48. The latch sub 48 is configured to seal against the connector 52 of the proximal downhole tool 30 and establish flow communication between the second flow-through passage 56 and the first flow-through passage 54 upon engagement with the connector 52.

The release mechanism 46 allows selective disconnection of at least a portion of the coiled tubing 32 from at least a portion of the proximal downhole tool 30 (e.g., the anchor 12A) after engagement of the latch sub 48 with the connector 52. For example, the release mechanism 46 may be implemented as described in U.S. Pat. No. 7,337,519, which is incorporated herein by reference in its entirety for all purposes. However, other known release mechanisms may be used. The release mechanism can be provided elsewhere along the proximal downhole tool 30, the coupling tool 40, or the coiled tubing 32. For example, the latch sub 48 and the release mechanism 46 may be provided on a single sub.

Figure 3:
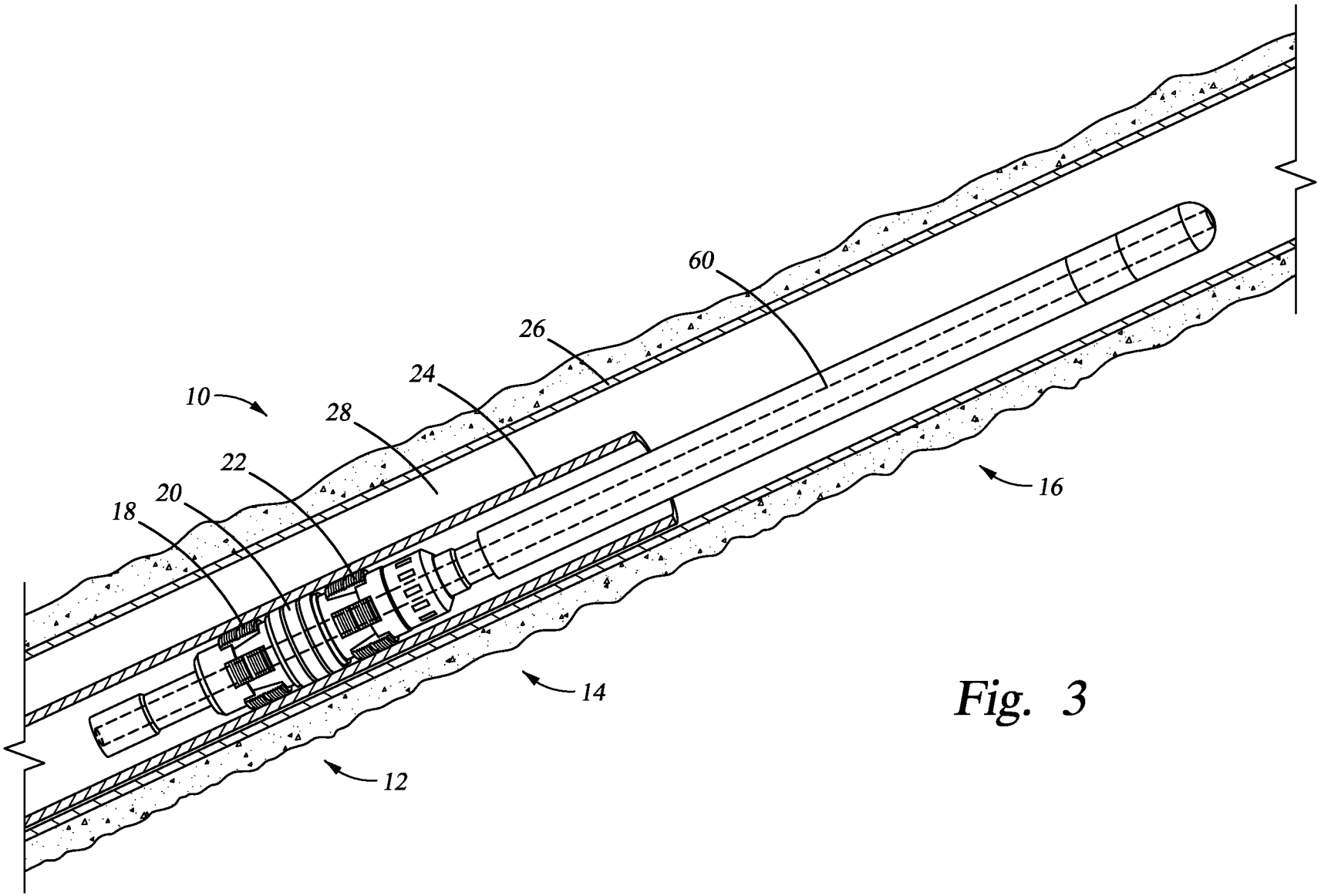
FIG. 3 illustrates an example embodiment of a downhole tool shown offset from the coiled tubing in FIG. 1A.

FIG. 3 illustrates an embodiment of the distal downhole tool 10 shown in FIGS. 1A and 1B.

The distal downhole tool 10 includes an anchor 12 (e.g., including slip/cone assemblies 18 and 22 and packer 20), a flow-through passage 60 (shown in ghost lines) extending along the distal downhole tool 10, and a vibration device 16, such as previously described.

In use, the distal downhole tool 10 is suspended to a setting tool (not shown) and lowered via wireline inside a tubing, for example, the production tubing 24 before the proximal downhole tool 30 is deployed. When the anchor 12 of the distal downhole tool 10 is located near a lower end of the production tubing 24, the setting tool is activated. The activation of the setting tool extends the slips of the slip/cone assemblies 18 and 22 so that the slips grip against the production tubing 24, and expands the packer 20 so that an annulus between the production tubing 24 and the distal downhole tool 10 is sealed. The setting tool and the wireline may then be retrieved. Other known types of anchors may be used in the distal downhole tool 10 instead of, or in addition to, the anchor 12 including the slip/cone assemblies 18 and 22 that are activated by a setting tool.

When the cement is pumped down into the production tubing 24, it eventually flows through the flow-through passage 60 inside the distal downhole tool 10. After leaving the distal downhole tool 10, the cement flows up in an annulus between the production tubing 24 and the casing 26. As the cement flows through the flow-through passage 60 inside the vibration device 16, pressure pulses, lateral oscillations, and/or axial oscillations are generated. The pressure pulses, lateral oscillations, and/or axial oscillations may ensure that the cement remains fluid before it sets (i.e., it is cured) and that the distribution of the cement in the annulus between the production tubing 24 and the casing 26 is uniform.

Optionally, a burst sub 14 may be provided to bypass the vibration device 16 if the vibration device 16 is plugged, so that the cementing operation may continue, although without the generation of pressure pulses, lateral oscillations, and/or axial oscillations.

Figure 4:
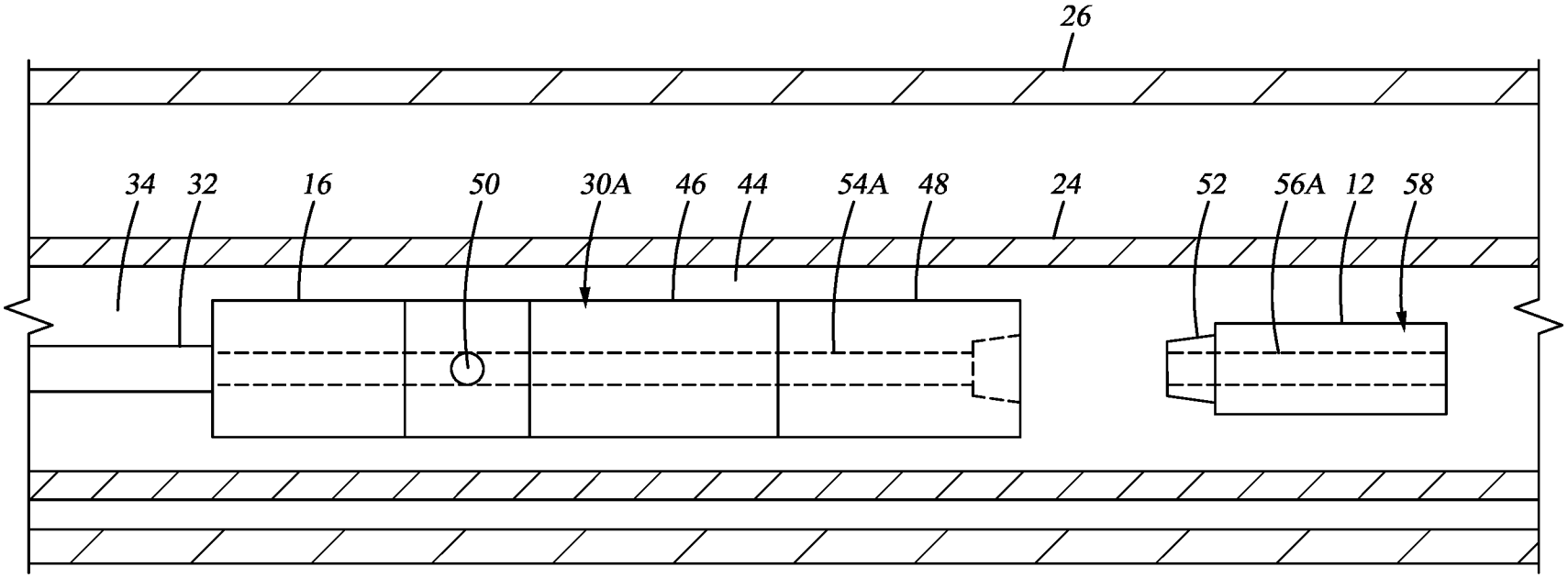
FIG. 4 illustrates an alternative embodiment of the downhole tools shown in FIG. 2.

FIG. 4 illustrates another arrangement of the proximal downhole tool 30 shown in FIG. 1A.

The arrangement shown in FIG. 4 includes an attachment tool 58, which includes an anchor 12 and a connector 52. A flow-through passage 56A extends along the attachment tool 58 through the connector 52 to an end of the attachment tool 58 opposite the connector. Preferably, the attachment tool 58 shown in FIG. 4 may not comprise a vibration device 16, although such vibration device 16 may optionally be provided in a way similar to FIG. 2. Further, the attachment tool 58 preferably includes a packer, which may be provided in an anchor 12 between two slip/cone assemblies.

Similarly to the arrangement illustrated in FIG. 2, the proximal downhole tool 30A includes a vibration device 16. In contrast with the arrangement illustrated in FIG. 2, the proximal downhole tool 30A also includes an unloader valve sub 44. The flow-through passage 54A (shown in ghost lines) further extends through the unloader valve sub 44. The unloader valve sub 44 includes a port 50 that can provide fluid communication between the flow-through passage 54A and the annulus 34 between the production tubing 24 and the coiled tubing 32. The unloader valve sub 44 has a first position wherein flow is prevented or at least hindered through the port 50 and a second position wherein flow is allowed through the port 50. For example, the tension on the coiled tubing 32 may be cycled to shift a sleeve and open the port 50. However, other known types of circulation subs may be used. Furthermore, the proximal downhole tool 30A comprises the latch sub 48, and a release mechanism 46. The flow-through passage 54A extends from the coiled tubing 32 through the release mechanism 46 and the latch sub 48. The latch sub 48 is configured to seal against the connector 52 of the proximal downhole tool 30A and establish flow communication between the flow-through passage 56A and the flow-through passage 54A upon engagement with the connector 52.

In use, the attachment tool 58 may be connected to a setting tool and placed in the production tubing 24 using conveyance means, such as wireline, coiled tubing, or other known conveyance means, after the distal downhole tool 10 (in FIG. 1A) is deployed. Then, the conveyance means is retrieved. In contrast with the embodiment shown in FIG. 2, the proximal downhole tool 30A may be deployed using coiled tubing 32.

The port 50 of the unloader valve sub 44 is initially closed. Cement pumped into the coiled tubing 32 flows through the vibration device 16 and generates at least one of pressure pulses, lateral oscillations, and axial oscillations. Then, the port 50 of the unloader valve sub 44 is shifted to the second position establishing fluid communication between the flow-through passage 54A and the annulus 34. While the cement 42 is curing, the generation of at least one of pressure pulses, lateral oscillations, and axial oscillations may continue by pumping a fluid, usually other than cement, into the coiled tubing 32, through the vibration device 16, and out of the port 50 of the unloader valve sub 44. Then, the fluid flows back into the annulus 34 toward the wellhead (or toward the packer 38, which has been retracted). In contrast with the embodiment shown in FIG. 2, the proximal downhole tool 30A is retrievable using coiled tubing 32.

In yet other arrangements, an attachment tool 58, a proximal downhole tool 30A, and a setting tool may first be coupled together to form a tool string. The attachment tool 58 and the proximal downhole tool 30A may have the configuration illustrated in FIG. 4, or may be rearranged to form the tool string. In contrast with the arrangement illustrated in FIG. 4, the tool string may then be provided in the production tubing 24 in a single trip, using conveyance means, such as wireline, coiled tubing, or other known conveyance means, after the distal downhole tool 10 (in FIG. 1A) is deployed. After the tool string is properly located in the production tubing 24, the setting tool is activated, and the anchor of the proximal downhole tool is attached to the production tubing 24. Then, the conveyance means is retrieved.

The cement can be pumped down in the production tubing 24, i.e., without providing a coiled tubing in the production tubing 24, generating pressure pulses and/or oscillations. Once the cement 42 is in place between the production tubing 24 and the casing 26, the port 50 of the unloader valve sub 44 is shifted to the second position by dropping an obturator, such as a dissolvable ball or a dart, that lands on a spring-loaded seat to seal or restraint the flow-through passage 54A and by applying hydraulic pressure on the obturator. For example, upon compression of the spring, the vibration device 16 may move, and the movement may drive the unloader valve sub 44 so that flow is allowed through the port 50.

Similarly to FIG. 2, the coiled tubing 32 is lowered inside the production tubing 24 until a latch sub engages with a connector of the proximal downhole tool 30A. The generation of pressure pulses and/or oscillations can continue as described herein. A portion of the tool string may then be retrieved, for example, leaving at least the anchor attached in the production tubing 24.

Figure 5:
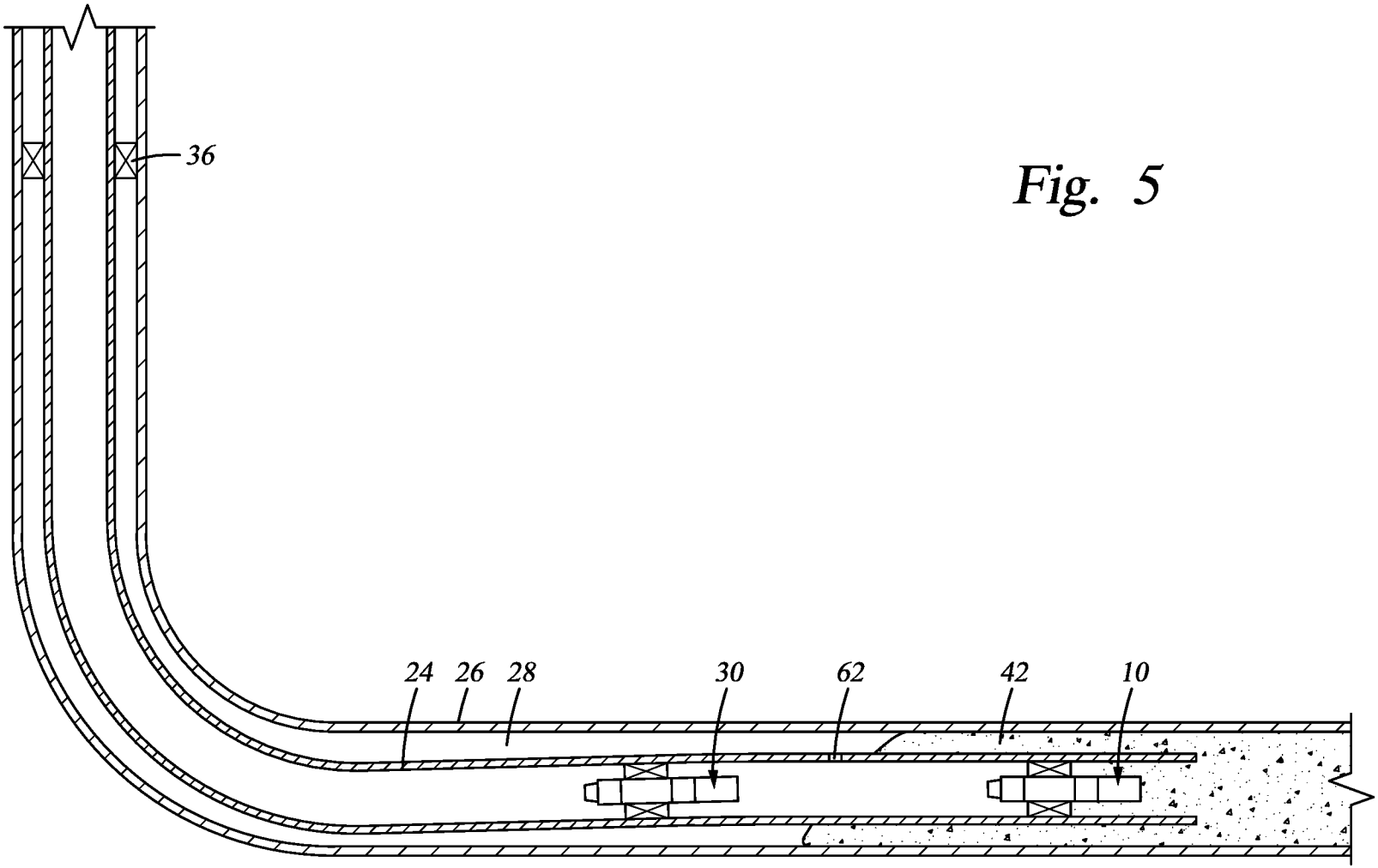
FIG. 5 illustrates another example embodiment of a system for cementing a production tubing that utilizes at least one of pressure pulses, lateral oscillations, and axial oscillations during the pumping and/or the curing of the cement.

FIG. 5 illustrates the operation of another system for cementing a tubing, such as a production tubing 24 that is located inside a casing 26. In the system shown in FIG. 5, a punch or hole 62 is made in the production tubing 24, at a location closer to the wellhead than the section to be cemented. As shown in FIG. 5, the casing 26 and/or the production tubing 24 may be located in a horizontal or highly deviated well; however, the system may alternatively be used in wells having a different configuration.

The system may include a distal downhole tool 10 and a proximal downhole tool 30 that each includes a flow-through passage along the tool and a vibration device. The vibration device can generate at least one of pressure pulses, lateral oscillations, and axial oscillations during the pumping of the cement or other fluid in the flow-through passage. The distal downhole tool 10 and the proximal downhole tool 30 are attached to the production tubing 24 on opposite sides of the hole 62. While FIG. 5 shows only one distal downhole tool 10, a plurality of distal downhole tools may further be distributed along the production tubing 24, each offset from each other and from the proximal downhole tool 30.

In use, cement 42 may be pumped into the production tubing 24, flow in the flow-through passage of the distal downhole tool 10 and the proximal downhole tool 30, and generate at least one of pressure pulses, lateral oscillations, and axial oscillations during the pumping of the cement. The cement reaches the end of the production tubing 24 and fills into an annulus 28 between the production tubing 24 and the casing 26. Optionally, an annular seal 36 may be provided and be partially choked to provide a squeeze pressure on the cement 42. The hole 62 is preferably sufficiently small such that little or no cement escapes through the hole 62 into the annulus 28.

Then, a fluid less viscous than the cement 42 is pumped into the production tubing 24. Because viscous forces resist the displacement of the cement 42, the fluid may preferably escape the production tubing 24 through the hole 62. Accordingly, the fluid may not flow in the flow-through passage of the distal downhole tool 10. However, the fluid may flow in the flow-through passage of the proximal downhole tool 30 and generate at least one of pressure pulses, lateral oscillations, and axial oscillations during the pumping of the fluid.

In some embodiments, the hole 62 may be made by a punching sub provided in the proximal downhole tool 30. For example, once the cement 42 is in place between the production tubing 24 and the casing 26, an obturator, such as a dissolvable ball or a dart, may be dropped and may land on a spring-loaded seat to seal or restraint the flow-through passage of the proximal downhole tool 30. The hole 62 may be made by applying hydraulic pressure on the obturator.

Specific embodiments are shown by way of example in the drawings and description. It should be understood, however, that the drawings and detailed description thereto are not intended to limit the claims to the particular form disclosed, but on the contrary, the intention is to cover all modifications, equivalents, and alternatives falling within the scope of the claims.

What is claimed is:

1. A method of cementing a tubing, comprising:

attaching a distal downhole tool in the tubing, the distal downhole tool including a first flow-through passage extending through the distal downhole tool and a first vibration tool;

attaching a proximal downhole tool in the tubing, the proximal downhole tool including a second flow-through passage extending through the proximal downhole tool and a second vibration tool;

generating at least one of pressure pulses, lateral oscillations, and axial oscillations with the second vibration tool by flowing cement in the second flow-through passage;

generating at least one of pressure pulses, lateral oscillations, and axial oscillations with the first vibration tool by flowing the cement in the first flow-through passage;

flowing cement around a portion of the tubing;

providing a backflow path from a point downstream of the second vibration tool toward a wellhead;

generating at least one of pressure pulses, lateral oscillations, and axial oscillations with the second vibration tool by flowing fluid other than the cement through the second flow-through passage while the cement is curing; and flowing the fluid in the backflow path.

2. The method of claim 1, wherein the backflow path from the point downstream of the second vibration tool toward the wellhead is provided with an annular space between the tubing and a casing surrounding the tubing, or an annular space between the tubing and a circulation means located inside the tubing.

3. The method of claim 1, wherein attaching the distal downhole tool in the tubing comprises extending an anchor including one or more slip-cone assemblies and causing the slips to grip against the tubing, or latching the distal downhole tool to a nipple profile forming a part of the tubing.

4. The method of claim 1, wherein attaching the proximal downhole tool in the tubing comprises extending an anchor including one or more slip-cone assemblies and causing the slips to grip against the tubing, or latching the proximal downhole tool to a nipple profile forming a part of the tubing.

5. The method of claim 1, further comprising preventing flow of cement between the distal downhole tool and the tubing using a packer included in the distal downhole tool.

6. The method of claim 1, further comprising applying a squeeze pressure to the cement while the cement is curing.

7. The method of claim 1, wherein the fluid includes Lost Circulation Material (LCM).

8. A system for cementing a tubing, comprising:

a distal downhole tool including means for attaching the distal downhole tool in the tubing, a first flow-through passage extending through the distal downhole tool, and a first vibration tool, wherein the first vibration tool is capable of generating at least one of pressure pulses, lateral oscillations, and axial oscillations by flowing cement in the first flow-through passage;

a proximal downhole tool including means for attaching the proximal downhole tool in the tubing, a second flow-through passage extending through the proximal downhole tool, and a second vibration tool, wherein the second vibration tool is capable of generating at least one of pressure pulses, lateral oscillations, and axial oscillations by flowing the cement in the second flow-through passage and by flowing fluid other than the cement through the second flow-through passage while the cement is curing; and means for providing a backflow path from a point downstream of the second vibration tool toward a wellhead, wherein the means for providing the backflow path from the point downstream of the second vibration tool toward the wellhead includes an annular space between the tubing and a circulation means located inside the tubing.

9. The system of claim 8, wherein the means for providing the backflow path from the point downstream of the second vibration tool toward the wellhead includes a packer located near or at the wellhead, or an unloader valve connected to the second flow-through passage.

10. The system of claim 8, wherein the means for attaching the distal downhole tool in the tubing comprises an extendable anchor including one or more slip-cone assemblies, or a mechanism for latching the distal downhole tool to a nipple profile forming a part of the tubing.

11. The system of claim 8, wherein the means for attaching the proximal downhole tool in the tubing comprises an extendable anchor including one or more slip-cone assemblies, or a mechanism for latching the proximal downhole tool to a nipple profile forming a part of the tubing.

12. The system of claim 8, wherein the distal downhole tool further includes a packer capable of preventing flow of the cement between the distal downhole tool and the tubing.

13. The system of claim 8, wherein the first vibration tool and the second vibration tool each include at least one of a pressure-pulser and an agitator.

14. The system of claim 8, wherein the backflow path bypasses an annular space surrounding a lower portion of the tubing, whereby the cement in the annular space sets.

15. A system for cementing a tubing, comprising:

a distal downhole tool including means for attaching the distal downhole tool in the tubing, a first flow-through passage extending through the distal downhole tool, and a first vibration tool, wherein the first vibration tool is capable of generating at least one of pressure pulses, lateral oscillations, and axial oscillations by flowing cement in the first flow-through passage;

a proximal downhole tool including means for attaching the proximal downhole tool in the tubing, a second flow-through passage extending through the proximal downhole tool, and a second vibration tool, wherein the second vibration tool is capable of generating at least one of pressure pulses, lateral oscillations, and axial oscillations by flowing the cement in the second flow-through passage and by flowing fluid other than the cement through the second flow-through passage while the cement is curing; and means for providing a backflow path from a point downstream of the second vibration tool toward a wellhead, wherein the backflow path bypasses an annular space surrounding a lower portion of the tubing, whereby the cement in the annular space sets, wherein the means for providing the backflow path from the point downstream of the second vibration tool toward the wellhead includes an annular space between the tubing and a casing surrounding the tubing.

16. The system of claim 15, wherein the means for providing the backflow path from the point downstream of the second vibration tool toward the wellhead includes a hole in the tubing, made at a location closer to the wellhead than a section to be cemented.

17. The method of claim 1 or 2, wherein the backflow path passes through a hole in the tubing, a packer located near or at the wellhead, or an unloader valve connected to the second flow-through passage.

* * * * *